US006623288B2

(12) United States Patent
Sakiyama et al.

(10) Patent No.: US 6,623,288 B2
(45) Date of Patent: Sep. 23, 2003

(54) MALE-TYPE TERMINAL AND CONNECTOR AND ELECTRIC-CONNECTION STRUCTURE USING THE SAME

(75) Inventors: Koji Sakiyama, Sakura (JP); Yasuo Takemura, Ichikawa (JP); Kohki Ishikawa, Chiba (JP)

(73) Assignee: Fujikura Ltd., Tokyo (JP)

( * ) Notice: Subject to any disclaimer, the term of this patent is extended or adjusted under 35 U.S.C. 154(b) by 0 days.

(21) Appl. No.: 09/814,966

(22) Filed: Mar. 23, 2001

(65) Prior Publication Data

US 2001/0024895 A1 Sep. 27, 2001

(30) Foreign Application Priority Data

Mar. 24, 2000 (JP) ..... 2000-084991

(51) Int. Cl.[7] ..... H01R 13/53
(52) U.S. Cl. ..... 439/181; 439/931

(58) Field of Search ..... 439/181, 59, 931, 439/951, 886

(56) References Cited

U.S. PATENT DOCUMENTS 6,200,146 B1 * 3/2001 Sarkissian ..... 439/79
6,296,499 B1 * 10/2001 Hermann, Jr. et al. ..... 439/181

* cited by examiner

*Primary Examiner*—Khiem Nguyen
(74) *Attorney, Agent, or Firm*—Sughrue Mion, PLLC

(57) ABSTRACT

The present invention provides such a structure that a male-type terminal which in inserted to a female-type terminal to come in contact therewith comprises a resistor on at least a tip portion of a resistor and that at the time of insertion to the female-type terminal, a switching is made from the resistor to the conductor portion and, at the time of detachment from the female-type terminal, switching is made from the conductor portion to the resistor.

20 Claims, 4 Drawing Sheets

LOAD POWER VS. DEGREE OF MELTED-AND-LOST PHENOMENON AT TERMINAL

MALE-TYPE TERMINAL AND CONNECTOR AND ELECTRIC-CONNECTION STRUCTURE USING THE SAME

CROSS-REFERENCE TO RELATED APPLICATIONS

This application is based upon and claims the benefit of priority from the prior Japanese Patent Application No. 2000-084991, filed Mar. 24, 2000, the entire contents of which are incorporated herein by reference.

BACKGROUND OF THE INVENTION

The present invention relates to a male-type terminal and a connector and an electric-connection structure using the same applicable to a connecting portion of a harness, a fuse block, etc. connected to a large power load used in, for example, an automobile wiring system.

There has conventionally been known a connector for an automobile wire harness that has this type of electric-connection structure. The connector is made by pressing its male-type terminal and a female-type terminal as well as a plate-shaped piece made of copper or copper alloy and then plating them with tin usually. Furthermore, some connector terminals used in an electric automobile are plated partially with silver.

Ecological requirements and demands for improvements in the fuel efficiency in the recent years have been transforming mechanical control into electric control for the automobile equipment. For example, as for the power steering, a so-called electric power steering has been developed for generating power electrically in place of the conventional one for generating power by the rotation of the engine. Accordingly, the current electric load of up to about a few hundred watts is expected to amount to a few kilowatts in the future. Furthermore, from the viewpoint of improving the efficiency of supplying power, the current source voltage of 14V in a vehicle may rise to 42V in the future.

If a user detaches or inserts the connector of a harness connected to a load being supplied with a large power from such a voltage-elevated power source during operation, arc discharge occurs at the tip of a male-type or female-type terminal, which may be melted and lost.

BRIEF SUMMARY OF THE INVENTION

In view of the above, it is an object of the invention to provide a male-type terminal, a connector, and an electric-connection structure which can prevent arc discharge from occurring at an electric connection and hence a melted-and-lost phenomenon of the terminal portion.

A male-type terminal according to a first aspect of the invention comprises a conductor portion inserted to a female-type terminal and a resistor provided on at least the tip of this conductor portion, wherein at the time of insertion to the above-mentioned female-type terminal, switching is made from the above-mentioned resistor to the above-mentioned conductor portion and, at the time of detaching from the above-mentioned female-type terminal, switching is made from the above-mentioned conductor portion to the above-mentioned resistor.

Thus, by the invention, the male-type terminal can be brought into contact with the female-type terminal via the resistor to reduce a load power due to the resistor, thus effectively suppressing the occurrence of arc discharge to prevent the terminal from being melt and lost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The following will describe preferred embodiments of the invention with reference to the accompanying drawings.

First Embodiment

Figure 1:
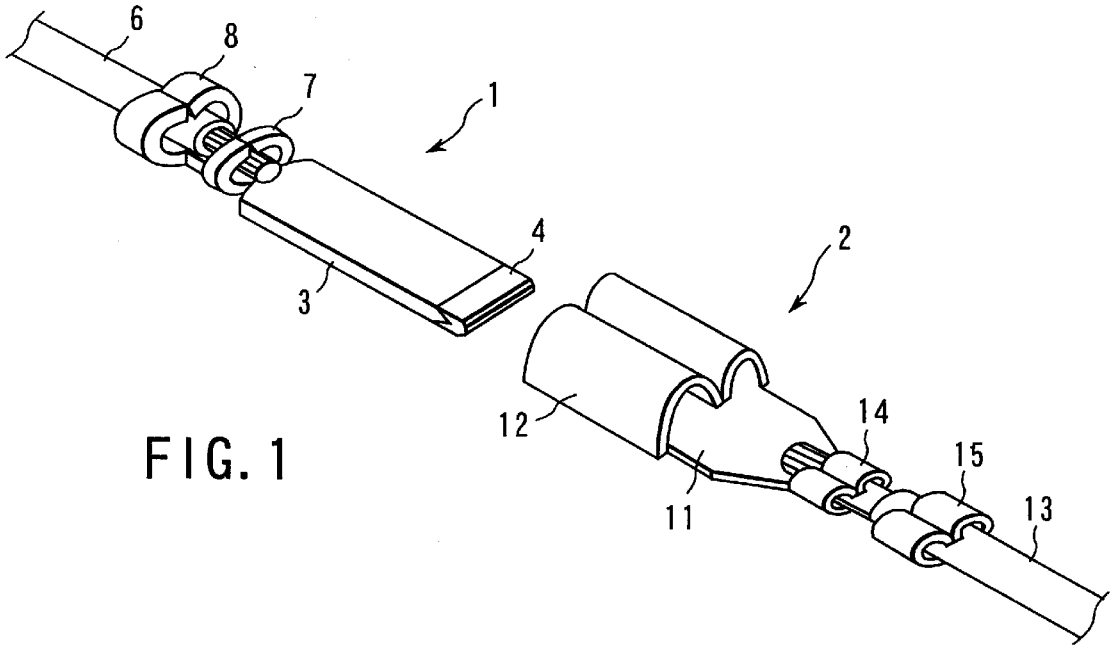
FIG. 1 is a perspective view of a connector terminal related to a first embodiment of the invention.

FIG. 1 is a perspective view of a connector terminal related to a first embodiment of the invention and FIG. 2, a side view showing part thereof in cross section.

This connector comprises a male-type terminal 1 and a female-type terminal 2 to which the male-type terminal 1 is inserted. The male-type terminal 1 comprises a conductor plate 3 having such a width, a length, and a thickness that enables the terminal 1 to be inserted to the female-type terminal and a resistor 4 disposed at the tip of the conductor plate 3. The resistor 4 is formed in such manner that its cross section perpendicular to its insertion/detachment direction may decrease gradually from the tip side to the base end side, forming a V-groove on the base end side. The tip portion of the conductor plate 3 is formed in a knife edge that fits to the V-groove of the resistor 4. Accordingly, the resistor 4 is buried in and adhered to the tip of the conductor plate 3 so that the vertical plane of the conductor plate 3 may be continuous with that of the resistor 4 in the same plane. At the base end portion of the conductor plate 3 are formed a conductor fixing portion 7 at which the conductor tip of a wire 6 is fixed and a sheath fixing portion 8 at which a sheathing portion of the wire 6 is fixed. It is here noted that the conductor plate 3 may be made of, for example, copper, brass, etc. The resistor 4, on the other hand, may be made of carbon, tungsten, etc. excellent in arc-discharge resistance.

The female-type terminal 2, on the other hand, has a structure similar to a conventional one in comprising a conductor plate 11 that its tip portion curves from its sides inward toward its center line and that a contact portion 12 is formed which comes in contact with the conductor plate 3 of the male-type terminal 1 at the tip portion which comes near the inside. As in the case of the male-type terminal 1, at the base end portion of this conductor plate 11 are also formed a conductor fixing portion 14 at which the tip portion of a wire 13 is fixed and a sheath fixing portion 15 at which the sheathing portion of a wire 13 is fixed.

Figure 2A:
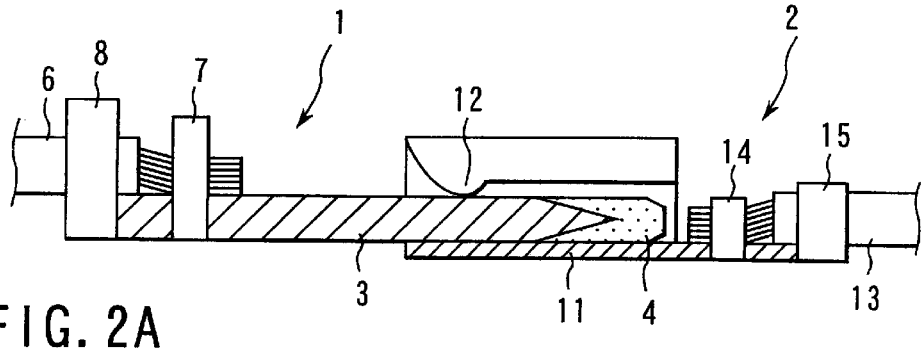
FIGS. 2A and 2B are side views showing, in cross sectional, part of a connector.
Figure 2B:
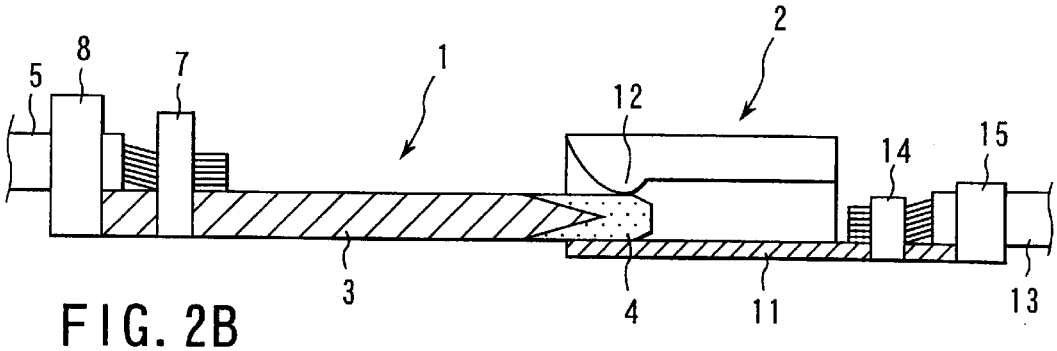

According to this constitution, as shown in FIG. 2A, in a state where the male-type terminal 1 is inserted in the female-type terminal 2, the conductor plate 3 of the male-type terminal 1 is in contact with the contact portion 12 of the female-type terminal 2 to thereby keep a conductive state. As shown in FIG. 2B, when the male-type terminal 1 is pulled out of the female-type terminal 2, the contact portion 12 of the female-type terminal 2 moves from the conductor plate 3 of the male-type terminal 1 to the resistor 4. The contact portion 12, however, is in connection with the conductor plate 3 via a thin portion of the resistor 4, to thereby be kept free of rapid fluctuations in load power, thus preventing the occurrence of discharge.

Figure 3:
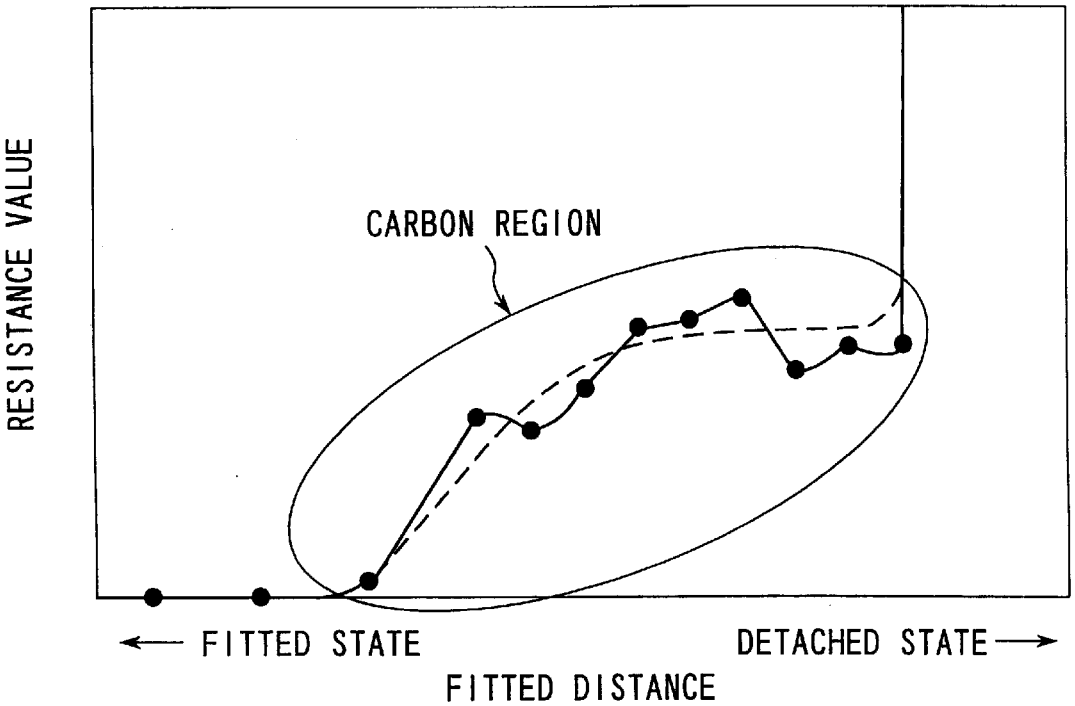
FIG. 3 is a graph showing a relationship between a fitting distance and an inter-terminal resistance for the connector of FIG. 2.

FIG. 3 is a graph indicating a relationship between a distance of fitting the male-type terminal 1 to the female-type terminal 2 and a resistance value between the two. An experiment with a carbon resistor as the resistor 4 came up found that the carbon resistance value smoothly changes from a fitted state to a detached state.

Figure 4:
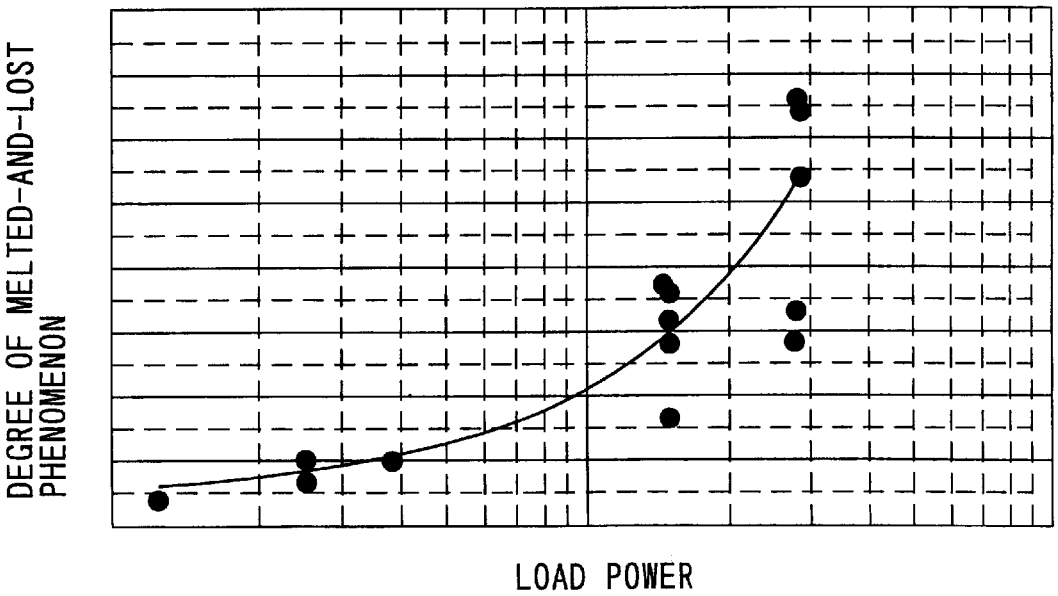
FIG. 4 is a graph showing a relationship between a lower power and a degree of melted-and-lost phenomenon.

FIG. 4 is a graph indicating a relationship between a load power and a degree of melted-and-lost phenomenon of the terminal. It is confirmed in the experiment that as shown in the figure, as the load power increases, the degree of the melted-and-lost phenomenon of the terminal caused by discharge is also increased. Therefore, the smaller the load resistance, the larger becomes the destructive force on the terminal caused by discharge. As can be seen from it, according to the connector of this embodiment, by providing the resistor 4 to the tip of the male-type terminal 1, the load resistance can be increased to thereby prevent the terminal from melted and lost.

Second Embodiment

Figure 5:
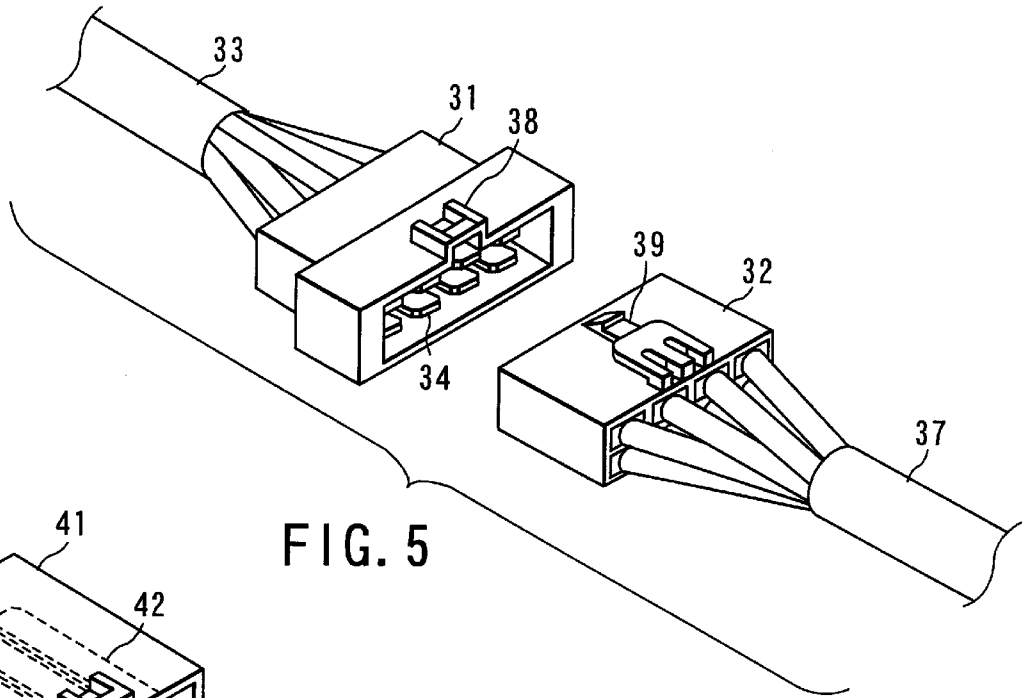
FIG. 5 is a perspective view of a connector related to a second embodiment of the invention.

FIG. 5 is a perspective view showing a connector related to a second embodiment of the invention.

The connector of this embodiment comprises a housing 31 and a female-type connector 32 to which this housing is fitted. As shown in a plan view of FIG. 6, the housing 31 has therein a male-type terminal string 34 in which a wire harness 33 is soldered to the base end portion. This male-type terminal string 34 has a recess formed at the portion of each comb tooth of an insulating base 35 formed in a shape of a comb, at which recess the strip-shaped conductor plate 36 is fitted and adhered and on the tip portion of which a resistor 40 is disposed. It is here noted that in this embodiment, the male-type terminal string 34 is vertically disposed in two steps. The insulating base 35 is preferably made of such a highly heat resistant material as ceramic, enamel aluminum nitride, etc. having a high melting point, e.g. 2000° C.

The female-type connector 32 comprises, like a conventional one, a female-type terminal (not shown) to which each comb tooth of the male-type terminal string 34 is inserted, the base end portion of which female-type terminal is connected with a wire harness 37 by, e.g. caulking. The housing 31 and the female-type connector 32 are prevented from being pulled out from each other because snap-engaging portions 38 and 39 are engaged with each other in the fitted state. Also in this embodiment, when the housing 31 and the female-type connector 32 are attached to a detached from each other, both terminals come in contact with each other via the resistor 40 disposed on the tip portion of the male-type terminal string 34, thus suppressing discharge to prevent a melted-and-lost phenomenon and a fire of the terminal.

Third Embodiment

Figure 7:
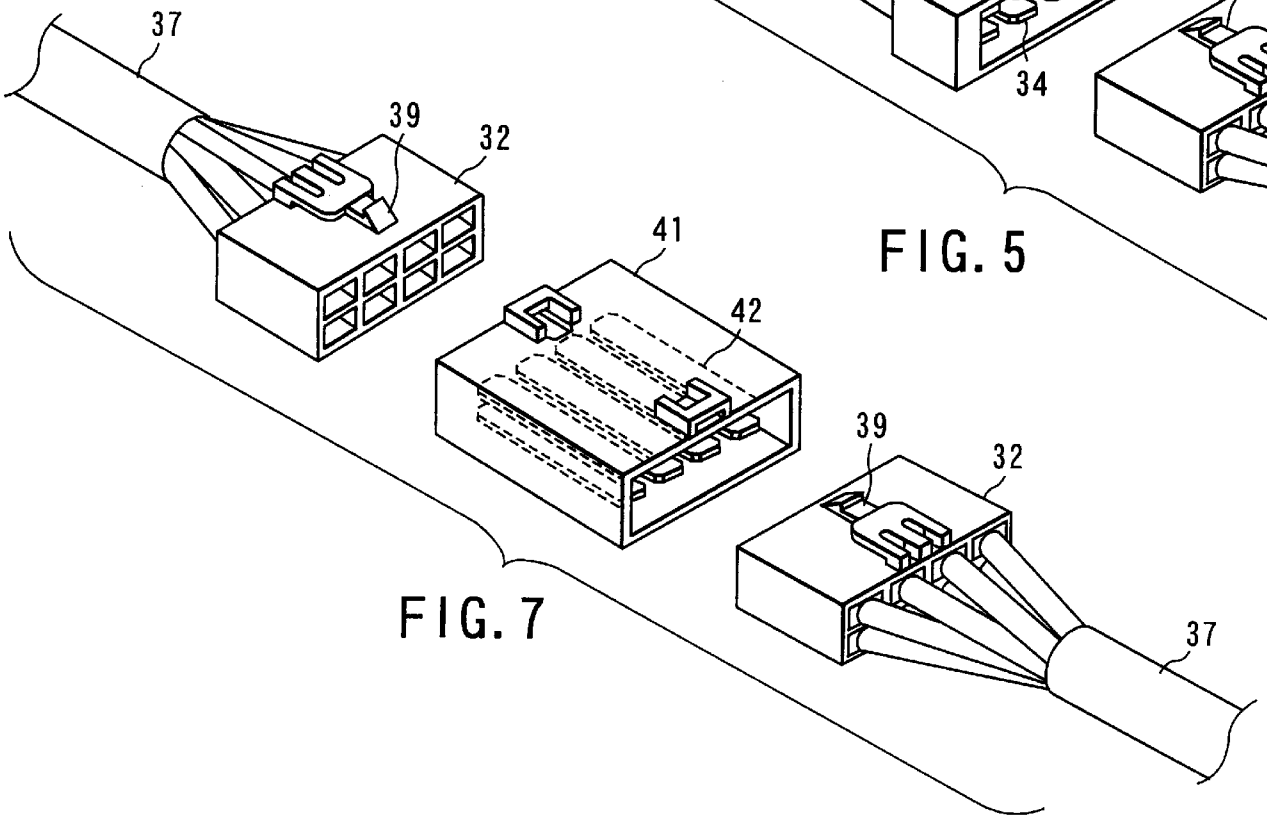
FIG. 7 is a perspective view showing a connector related to a connector related to a third embodiment of the invention.
Figure 6:
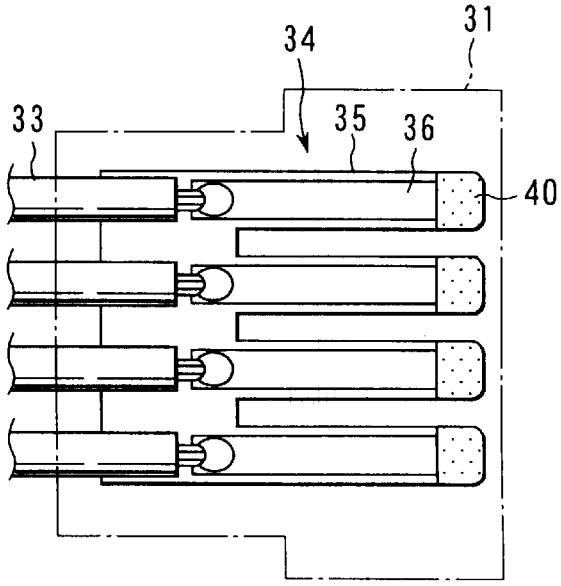
FIG. 6 is a plan view showing a male-type terminal incorporated in a housing of the connector of FIG. 2.

FIG. 7 is a perspective view showing a third embodiment for connecting the two female-type connectors 32 shown in FIG. 6 via a housing 41.

Figure 8:
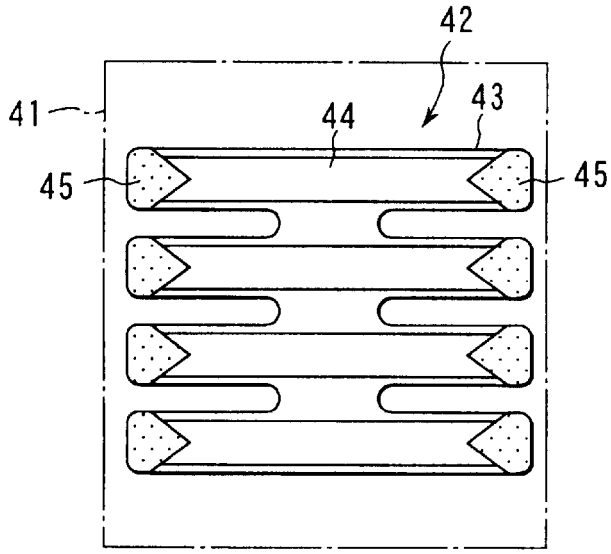
FIG. 8 is a plan view showing a male-type terminal incorporated in a housing of the connector of FIG. 6.

In this embodiment, as shown in FIG. 8, the housing 41 has therein a male-type terminal string 42 having a male-type terminal at its both ends. The male-type terminal string 42 comprises an insulator base 43 having its both ends formed in a comb shape, a strip-shaped conductor plate 44 adhered to each comb tooth portion of the insulator base 43, and a resistor 45 provided at the tip of both comb teeth. In this embodiment, the resistor 45 has such a planar shape that provides a V-shape of the base end portion, such that each time its portion coming into contact with the female-type terminal moves toward the base end side, the resistance value between the two terminals may decrease. It is here noted that also in this embodiment, the male-type terminal string 42 is provided in two steps vertically.

Fourth Embodiment

Figure 9A:
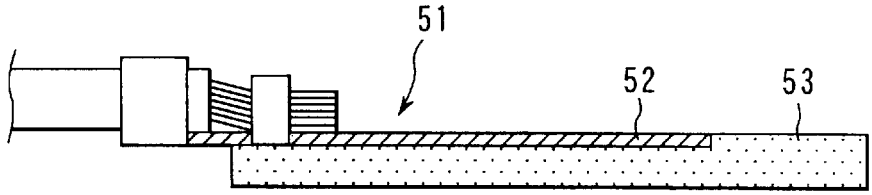
FIGS. 9A and 9B are side views showing, in cross section, part of a fourth embodiment of the invention.
Figure 9B:
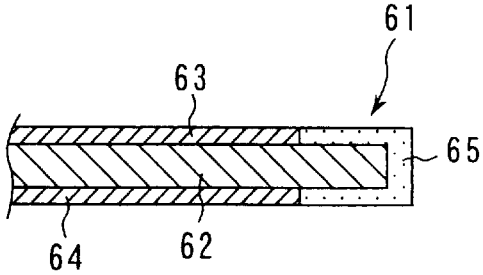

FIGS. 9A and 9B show a fourth embodiment of the invention.

FIG. 9A shows an example where a resistor plate 53 is additionally provided onto the back surface of a conductor plate 52 constituting a male-type terminal 51. It is here noted that in the case of the above-mentioned terminal string, a conductor may be formed on the upper surface of the resistor plate by printing, vapor deposition, plating, etc. FIG. 9B shows an example where on both surfaces of an insulating plate 62 constituting a male-type terminal 61 are conductive layers 63 and 64 by vapor deposition, printing, plating, etc. and a resistor 65 is formed at the tip portion. This example is particularly suited for manufacturing the male-type terminal string shown in FIGS. 6 and 8. Alternatively, for example, the resistor may be formed at the tip of the conductor plate by molding, vapor deposition, printing, adhesion, bury-in, etc.

The above-mentioned embodiments are all of a very simple construction to suppress increases in costs as much as possible and has a merit that conventional female-type terminals and connectors can be used as are. The invention is applicable not only to the above-mentioned types of connectors but also to, for example, a fuse connection and any electric connection structures connected to a large power load.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A male-type terminal comprising:

a plate-shaped conductor portion inserted to a female-type terminal; and a resistor directly provided on at least an entire tip portion of the plate-shaped conductor portion wherein the resistor having a base end fitted to the conductor plate, said base end forming a V-groove;

the conductor plate having a tip portion forming a knife edge fitted into the V-shaped groove of the resistor, whereby a vertical plane of the conductor plate is continuous with a vertical plane of the resistor in a same plane; and wherein at the time of insertion to the female-type terminal, switching is made from the resistor to the conductor portion, and at the time of detachment from the female-type terminal, switching is made from the conductor portion to the resistor.

2. The male-type terminal according to claim 1, wherein the resistor is formed in such a manner that its cross section perpendicular to the direction of insertion to the female-type terminal may decrease from a tip side toward a base end side of the resistor.

3. A connector comprising the male-type terminal according to claim 1.

4. A connector comprising a plurality of the male-type terminals according to claim 1.

5. An electric connection structure comprising the male-type terminal and the female-type terminal according to claim 1.

6. A male-type terminal comprising:

a plate-shaped insulator inserted to a female-type terminal;

a conductor portion provided on at least one surface of the insulator by vapor deposition, printing, plating or adhesion; and a resistor provided on an entire tip portion of the conductor portion; and wherein the resistor having a base end fitted to the conductor portion, said base end forming a V-shaped groove, the plate-shape insulator having a tip portion provided with the conductor portion and forming a knife edge fitted into the V-shaped groove of the resistor, whereby a vertical plane of the conductor portion is continuous with a vertical plane of the resistor in a same plane.

7. The male-type terminal according to claim 6, wherein the resistor is formed in such a manner that its cross section perpendicular to the direction of insertion to the female-type terminal may decrease from a tip side toward a base end side of the resistor.

8. A connector comprising the male-type terminal according to claim 6.

9. A connector comprising a plurality of the male-type terminals according to claim 6.

10. An electric connection structure comprising the male-type terminal and the female-type terminal according to claim 6.

11. A male-type terminal comprising:

a plate-shaped resistor inserted to a female-type terminal; and a plate-shaped conductor portion provided on at least one surface of the resistor except at least its entire tip portion by vapor deposition, printing, plating or adhesion the resistor having a base end fitted to the conductor plate, said base end forming a V-groove;

the conductor plate having a tip portion forming a knife edge fitted into the V-shaped groove of the resistor, whereby a vertical plane of the conductor plate is continuous with a vertical plane of the resistor in a same plane.

12. The male-type terminal according to claim 11, wherein the resistor is formed in such a manner that its cross section perpendicular to the direction of insertion to the female-type terminal may decrease from tip side toward a base end portion of the resistor.

13. A connector comprising the male-type terminal according to claim 11.

14. A connector comprising a plurality of the male-type terminals according to claim 11.

15. An electric connection structure comprising the male-type terminal and the female-type terminal according to claim 11.

16. A male-type terminal comprising:

a plate-shaped conductor plate inserted to a female-type terminal; and a resistor provided on an entire tip of the conductor plate by molding, vapor deposition, printing, adhesion or bury-in; and wherein the resistor having a base end fitted to the conductor plate, said base end forming a V-shaped groove;

the conductor plate having a tip portion forming a knife edge fitted into the V-shaped groove of the resistor, whereby a vertical plane of the conductor plate is continuous with a vertical plane of the resistor in a same plane.

17. The male-type terminal according to claim 16, wherein the resistor is formed in such a manner that its cross section perpendicular to the direction of insertion to the female-type terminal may decease from a tip side toward a base end side of the resistor.

18. A connector comprising the male-type terminal according to claim 16.

19. A connector comprising a plurality of the male-type terminals according to claim 16.

20. An electric connection structure comprising the male-type terminal and the female-type terminal according to claim 16.

* * * * *